United States Patent [19]

Carlson

[11] 4,086,048

[45] Apr. 25, 1978

[54] SPARK IGNITED RECYCLING IGNITION SYSTEM WITH INTERLOCKING GAS VALVE CONTROL

[75] Inventor: Elmer A. Carlson, Agoura, Calif.

[73] Assignee: International Telephone and Telegraph Corporation, New York, N.Y.

[21] Appl. No.: 673,110

[22] Filed: Apr. 2, 1976

Related U.S. Application Data

[63] Continuation of Ser. No. 512,458, Oct. 7, 1974, abandoned.

[51] Int. Cl.[2] ..... F23Q 9/08

[52] U.S. Cl. ..... 431/46; 361/256; 431/54

[58] Field of Search ..... 431/43, 25, 27, 42, 431/46, 50, 53, 59, 66, 67, 69, 78, 54; 361/253, 256

[56] References Cited

U.S. PATENT DOCUMENTS

| | | | |
|---|---|---|---|
| 3,270,800 | 9/1966 | Deziel et al. | 431/69 |
| 3,395,968 | 8/1968 | Mobarry et al. | 431/50 |
| 3,405,998 | 10/1968 | Walbridge | 431/25 |
| 3,445,173 | 5/1969 | Malavasi et al. | 431/25 |
| 3,627,458 | 12/1971 | Wade | 431/50 |
| 3,662,185 | 5/1972 | Sapir | 431/66 |
| 3,832,123 | 8/1974 | Walbridge | 431/78 |

*Primary Examiner*—J. V. Truhe
*Assistant Examiner*—Clifford C. Shaw
*Attorney, Agent, or Firm*—A. Donald Stolzy

[57] ABSTRACT

An ignition system for heating appliances which burn gas or vaporous fuels. A spark igniter is programmed to ignite a pilot burner which in turn ignites a main burner. A flame rod is used to confirm to the control circuitry that pilot ignition has taken place before the main gas valve is opened. An initially closed timing control circuit opens the pilot gas valve but times out if ignition of the pilot does not occur within a predetermined time. Other circuit interlocking features are provided for overall fail-safe operation.

2 Claims, 2 Drawing Figures

SPARK IGNITED RECYCLING IGNITION SYSTEM WITH INTERLOCKING GAS VALVE CONTROL

This is a continuation of copending application Ser. No. 512,458 filed Oct. 7, 1974, now abandoned. The benefit of the filing data of said copending application is therefore hereby claimed for this application.

BACKGROUND OF THE INVENTION

1. Field of the Invention

The invention relates generally to gas appliance ignition systems, and more particularly to such systems in which spark ignited recycling pilots are employed. See also U.S. Pat. No. 3,832,123.

2. Description of the Prior Art

In the prior art, the problem of gas appliance ignition has been addressed variously. Until comparatively recently, most gas appliances such as furnaces, hot water heaters and cooking equipment, etc., have incorporated a continuously burning pilot flame. Such an appliance can be placed in full operation, i.e., a main burner or burners may be ignited conveniently without significant delay.

Safety and reliability have also been considered in the prior art.

Among those safety devices known and used in the prior art to prevent such events as the ignition of main burner gas when the pilot flame is not extant is the well-known pilot thermopile, "thermomag," and safety valve. In such systems, the power source for a solenoid operated main gas valve is derived from a pilot generator relying on the heat of the pilot itself. Thus, if the pilot is not burning, the main solenoid operated gas valve cannot be operated. There are, of course, a host of other arrangements addressing the same or similar problems in all branches of the gas appliance art ranging from large steam boilers on down to the smallest of household gas appliances.

More recently, concern for natural resource conservation has spawned a generation of devices for quickly and conveniently lighting gas appliances without the need for a continuously burning pilot.

One of the most promising of the new generation ignitor arrangements includes an electrical spark gap for causing gas ignition. One such device is described in U.S. Pat. No. 3,870,929 issued Mar. 11, 1975.

Many devices disclosed in the recent art, including the device described in the aforementioned U.S. Pat. No. 3,870,929, combine a spark gap ignitor with a so-called flame rod, the latter being a device known per se in boiler control and gas appliance systems generally. Briefly, the so-called flame rod is located so that the burner flame, when present, impinges at least partly upon it. The flame, when present, thus forms a "flame diode" or high resistance rectifier with the rod as the anode and the burner as the cathode. In the absence of flame the circuit between the flame rod and burner is an open circuit. With the flame impinging upon the rod, a current path having a resistance in the order of several megohms is presented. This phenomenon has been used to control safety devices to prevent the discharge or collection of unburned gas in the event that the ignition device does not operate properly for any reason. The aforementioned U.S. Pat. No. 3,870,929 illustrates and describes much of this current art.

Still more recently, spark ignitors have been applied to the ignition of a gas pilot which then ignites the main burner or burners in the well known way. The pilot flame, being a device of smaller gas utilization, does not present some of the problems which can result from delayed or inadequate ignition of a larger gas discharge. U.S. Pat. No. 3,662,185 describes the so-called flame rod in a spark ignition system. In that patent, the flame rectification or flame diode action provides an electrical inhibiting means by which the spark ignition device can be inhibited, once the pilot has ignited.

Within the current state of the art, no device is known combining the advantages of pilot spark ignition and interlocking solenoid safety valves to insure fail-safe and reliable gas appliance operation.

The use of spark igniters with gas fuel pilots presents certain unique problems in bringing about reliable and fail-safe operation and also creates certain opportunities for effecting economical and efficient electrical interlocking of the gas controls. In the prior art as in the combination of the present invention to be described hereinafter, solenoid operated gas valves are employed. Such valves are extremely well known and are extensively described in the patent literature. The art of constructing solenoid valves for gaseous or vaporous fuels and other fluids is well developed and they have been widely used in a variety of voltage and current sizes. U.S. Pat. Nos. 2,557,514; 2,589,574; 2,697,581; 2,719,939 and 2,947,510 provide but a small sampling of the art in solenoid operated valves.

The manner in which the present invention builds upon the prior art and substantially improves upon it will be evident as this description proceeds.

SUMMARY OF THE INVENTION

In accordance with the foregoing, it may be said to have been the general objective of the present invention to provide a spark ignited recycling ignition system using spark pilot ignition and having interlocking gas lock control for efficiency and fail-safety.

Briefly, the objective is accomplished through an unique combination involving two solenoid control valves, one identified as a pilot valve, the other a main gas valve feeding a main burner. The pilot valve is initially energized through a normally closed time delay device and during that time provides gas output from each of two ports, or from a single divided output port. One of the gas outputs feeds a pilot burner directly and another feeds a main burner through a second solenoid operated valve identified as a main gas valve. The time delay device is arranged to either interrupt the current to the pilot valve or reduce it to such a low value that the pilot valve closes, cutting off both gas outputs. This time delay provides for the confirmation of pilot ignition. A self-recycling pilot spark ignitor lights the pilot during this time in response to a start-switch command. Another current path is provided through a sensing circuit operated in connection with a flame rod so that, when the pilot flame is extant, both the main gas valve and pilot valves are held open through a current path other than as provided by the same time delay device. In this way, the discharge of gas through the orifices of the main burner can only occur if the pilot is indeed ignited.

The above-described and other advantages of the present invention will be better understood from the following detailed description when considered in connection with the accompanying drawings.

BRIEF DESCRIPTION OF THE DRAWING

In the drawings which are to be regarded as merely illustrative.

DESCRIPTION OF THE PREFERRED EMBODIMENT

Figure 1:
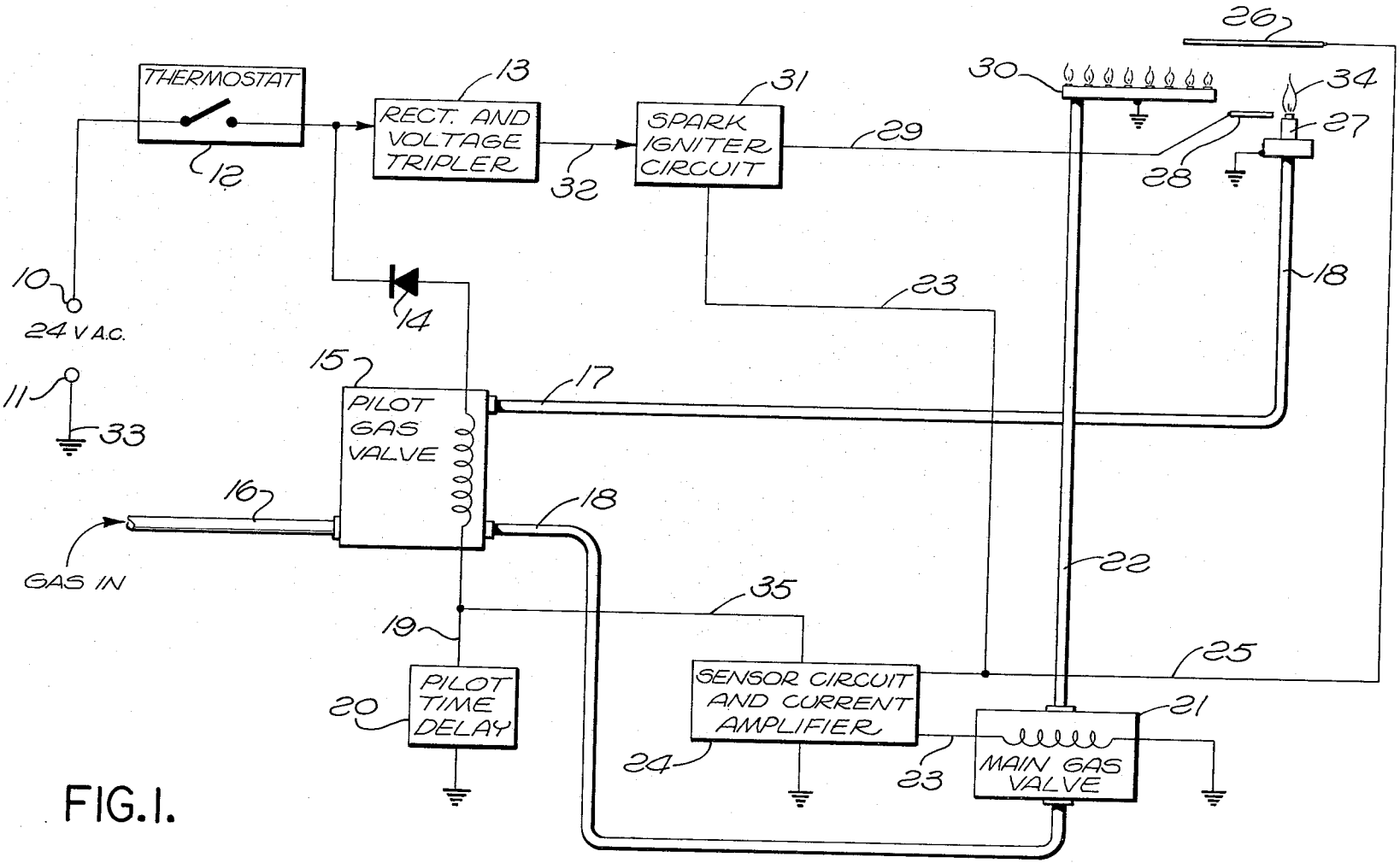
FIG. 1 is a block diagram of the combustible gas ignition system of the present invention.

Referring now to FIG. 1, a block diagram showing the main structural and functional aspects of a typical system in accordance with the present invention will be seen.

Although this embodiment of the invention is definitely not limited to use with a low-voltage A.C. supply, the particular design illustrated operates from 24 volts A.C. That voltage is found in certain residential heating equipment and other applications where low voltage wiring is used.

In FIG. 1 the terminals of the said 24-volt A.C. supply are 10 and 11, terminal 11 being grounded or becoming the common at 33. Wherever else the ground symbol is depicted in FIG. 1, it will be understood to represent a return to this common point 33.

The thermostat (start switch) 12 is the ordinary single-pole, single-throw temperature operated make-break device. Element 12 could obviously be a manual switch in parallel with a standard thermostat or could be merely a manual start switch.

Once the circuit closes at 12, the rectifying and voltage tripler circuit 13 is activated, and the pilot gas valve 15 is opened. The low voltage rectifier 14 in cooperation with a filter capacitor (shown on FIG. 2, but not on FIG. 1) provides a D.C. source for the pilot gas valve 15.

It will thus be seen that closure of the thermostat switch 12 provides a current source for the pilot gas valve and time delay circuit, and since the pilot time delay 20 is normally closed, it begins to conduct current immediately, thereby providing a current path through pilot gas valve 15 via lead 19, permitting gas from the input line 16 to flow in output lines 17 and 18. Neither of these lines 17 or 18 provides any gas supply when valve 15 is closed.

Fundamentally, this time delay 20 is a part of the fail-safe features of the circuit, and its purpose is to automatically "time-out," permitting the gas valve 15 to close, due to interruption of the current path through 20, unless other events in the circuit operate to keep 15 open, as will be discussed hereinafter.

The spark ignitor circuit 31 is also energized immediately, via 32, from the rectifying voltage tripler 13. That circuit provides a repeating spark between the spark electrode 28, via spark line 29, to the grounded body of the pilot burner itself.

If the pilot flame 34 is properly ignited as a result of the foregoing sequence, the flame rod 26 detects this fact. As hereinbefore indicated, this flame rod is essentially a high resistance diode poled to be conductive in a direction from flame rod 26 toward ground in the presence of the flame. Thus it may be said that there is a high resistance unilateral current path between the flame rod and the body of the pilot burner 27 through the flame 34. In the absence of the flame 34, the flame rod 26 and consequently line 25 are open circuited from 27.

Confirmation of pilot flame ignition produces several effects. First, this "flame signal" on line 25 operates to inhibit the spark ignitor circuit 31, so that it does not continue to provide sparks. Second, it provides a current path to replace the pilot time delay 20 which automatically opens its current path once sufficient time has been allowed to effect pilot ignition. Concurrently, the signal on 25 is provided to the sensor circuit and current amplifier 24, these devices providing the substitute current path via lead 35, to keep the valve 15 open. Circuit 24 also initiates a current on line 23 to open the main gas valve 21. This results in gas flow in gas line 22 to the main burner which then is ignited from the pilot flame essentially in the manner well known in the prior art. The ignition of the main burner from a pilot flame is a highly reliable and widely used technique.

Should the pilot flame 34, after ignition in accordance with the foregoing sequence, be extinguished for any reason, the flame rod conduction ceases, the current in 25 goes to zero, and circuit 24 ceases to supply a current path for pilot valve 15 or current on line 23 to the main gas valve 21 so that both the pilot valve 15 and the main gas valve 21 close. Similarly, the spark ignitor circuit is reactivated and continues to provide ignition sparks so long as the thermostat 12 is closed. The opening of thermostat 12 is required to recycle the pilot time delay 20 so that the aforementioned sequence of events leading to pilot burner ignition can recur.

The flame rod 26, as illustrated in FIG. 1, actually extends to some extent over the main burner 30, thus, a situation can be foreseen in which the pilot flame might fail after it ignited the main burner while the main burner continued to cooperate with the flame rod to keep itself in operation. In a practical situation it would be expected that the main burner flame would readily reignite the pilot burner, however this might not be true if, for example, clogging, water inundation, dripping water, or some other similar occurrence were responsible for the failure of the pilot. Until the interruption of the thermostat connection, however, the main burner could continue if it engaged the flame rod as aforesaid. Interruption of the thermostat connection disables all of the subassemblies of the device; however, the spark ignitor could continue to operate even though a failure closed the pilot and main burner solenoid valves, so long as the thermostat remains closed. This is not an unsafe situation and, in fact, can serve as a warning that a failure has occurred.

Figure 2:
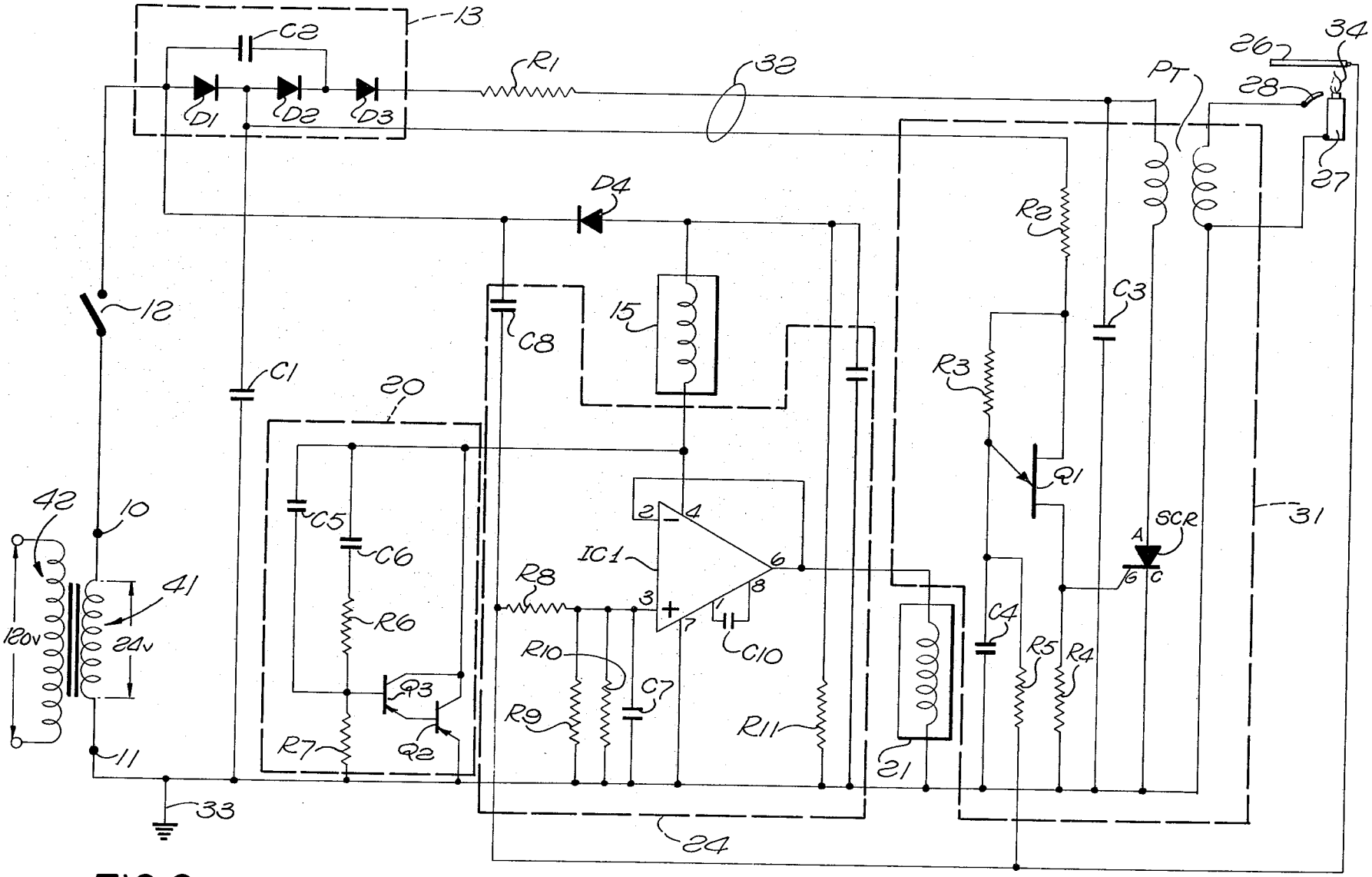
FIG. 2 is a schematic diagram of the invention shown in FIG. 1.

Referring now to FIG. 2, a more detailed showing of typical circuitry for the implementation of the present invention will be seen. The 24 volt A.C. input terminals 10 and 11 are shown supplied from a stepdown transformer secondary 41, the primary of the said transformer 42 being supplied from the 120 volt A.C. line. The terminal 11 is returned to the ground or common connection 33 as is already clear from FIG. 1. The rectifier and voltage tripler circuit 13 will be seen to comprise three series diodes D1, D2 and D3 with a capacitor C2 bridging D1 and D2. The operation of this circuit is entirely conventional per se, the output being supplied at 32. Actually 32 comprises two lines, one being at the highest voltage output (on the order of 100 volts) and having a series current limiting resistor R1. Another output is supplied to C1 and R2, as illustrated, at a voltage substantially only one-third of the 100 volts supplied to pulse transformer PT and one side of C3, as indicated.

It will be noted in FIG. 2 that the components comprising the pilot time delay 20 are enclosed in a dotted box, as are the components comprising the sensor circuit and current amplifier 24 and the spark ignitor circuit 31.

Considering the structure and operation of the pilot time delay circuit 20, it will first be noted that the main current path therethrough comprises the emitter-collector path of transistor Q2. The connection of transistor Q3 thereto constitutes a familiar direct coupled amplifier arrangement, so that there is substantial current amplification or gain between the base electrode of Q3 and the said emitter-collector path of Q2. It will be recognized that starting from a condition of no charge on capacitor C5 and C6, the potential applied to the base of Q3 and the resulting current therein is such as to place this current amplifier in a saturation or near saturation condition, so that current is immediately drawn through the pilot gas valve 15. As time passes however, the charging up of C5 and C6 gradually brings the base of Q3 down to a cutoff condition. In view of the substantial current gain in the circuit of Q2 and Q3, the transition from relatively a large current through valve 15 to little or no current therethrough is relatively abrupt after a predetermined time based on the values of R6, R7, and C5 and C6. Interruption of the power supply on the D4 side of valve 15 permits the discharge of C5 and C6 making 20 eligible for recycling from a new closure of thermostat switch 12.

The discharge of the filter capacitor C9 occurs rather quickly in view of the relatively small value of R11 at the time of opening of the thermostat switch 12, so that there is no significant lag in closure of 15 due to C9 storage.

As hereinbefore indicated, the spark igniter circuit goes into operation immediately upon closure of the thermostat switch 12 supplying power to R2 and C3 at the 33 and 100 volt (approximately) levels, respectively. Basically, and neglecting R5 for the moment, the circuit of Q1, including R3, C4, R4, R2, C3 and the SCR in cooperation with the primary of transformer PT comprises a pulse relaxation oscillator. Q1 is a unijunction transistor which has its emitter potential determined by the charge and discharge of C4. which has its emitter potential determined by the charge and discharge of C4. As C4 charges through R3, Q1 reaches the point of conduction raising the potential of the SCR gate element to the point of firing of the SCR. This produces a rush of current through the primary of PT, augmented by the charge on C3 and a corresponding spark through the step-up secondary of PT between spark electrode 28 and the pilot burner body 27.

As is a well known characteristic of a silicon controlled rectifier, such as the SCR in the present circuit, the dumping of the charge of C3 extinguishes the current path through the anode cathode circuit of SCR. C4 having been discharged by the conduction of Q1, now begins to recharge, in order to repeat the cycle. The connection between R5 and the flame electrode may be thought of as allowing conduction through the said flame diode on the negative half cycle of the AC potential which it receives through C8. Thus, the junction between the flame electrode 26 and R5 tends to go negative corresponding to ignition of the pilot flame 34, and this tends to bias the emitter electrode of the unijunction transistor Q1 so that the cycling of the circuit 31 is inhibited and no further spark generation occurs until the flame diode circuit opens as hereinbefore described.

This unijunction circuit is similar to that given in the General Electric Company's SCR Manual - 5th Edition, Sec. 4.14.2.1 thereof.

Concerning now the circuitry of the sensor and current amplifier 24, the same negative going potential due to operation of the flame rod, occurs at the junction of R8 and C8. That potential biases input number 3 of differential amplifier IC 1 so that current is permitted to flow into the main gas valve 21 from output 6 of the said IC 1, as well as through terminal 4 thereof which insures that the pilot gas valve 15 remains open notwithstanding the "time-out" of circuit 20, which is designed to occur a short time thereafter. Resistors R9 and R10 are, in effect, only one resistance since they are in parallel. Since these resistors are in the 20 megohm value range, comprising a net resistance of 10 megohms, there is an inherent redundancy advantage in that the opening up of either of these high value resistors still leaves 20 megohms in the circuit, sufficient to prevent a failure which might allow the integrated circuit to supply current to the main gas valve 21 at an improper time. The small capacitor C10 provides a stabilizing effect on IC 1, this integrated circuit with its hard feedback path from terminal 6 to terminal 2 amounts to a current amplifier having a voltage gain of substantially unity. The basic function of the circuit 24 will be understood to be the control of the current through the gas valves 15 and 21 in accordance with the condition of flame conduction at the flame rod 26.

Table I following gives typical values for a practical circuit in accordance with FIG. 2 with typical pilot and main gas valves of the solenoid type.

TABLE I

| Symbol | Value or Identification | Symbol | Value or Identification |
|---|---|---|---|
| $C_1$ | 1.00 μ fd | $R_6$ | 1.0 Meg Ω |
| $C_2$ | 0.33 μ fd | $R_7$ | 1.0 Meg Ω |
| $C_3$ | 2.2 μ fd | $R_8$ | 0.75 Meg Ω |
| $C_4$ | 0.01 μ fd | $R_9$ | 20 Meg Ω |
| $C_5$ | .33 μ fd | $R_{10}$ | 20 Meg Ω |
| $C_6$ | 1.0 μ fd | $R_{11}$ | 10 K Ω |
| $C_7$ | 0.1 μ fd | $Q_1$ | MU 10 (Motorola) |
| $C_8$ | 0.01 μ fd | $Q_2$ | TIP 32A (Texas Instruments) |
| $C_9$ | 150 μ fd | $Q_3$ | 2N2907 (Industry Standard) |
| $C_{10}$ | 15 pfd | SCR | Silicon Controlled Rectifier C-106 (General Electric) |
| $R_1$ | 1K Ω | $P_T$ | Step-up pulse transformer |
| $R_2$ | 10K Ω | $IC^1$ | (Integrated Circuit Amplifier) (Industry Standard LM 301A) |
| $R_3$ | 20 Meg Ω | $D_1$ | Silicon Solid State Diode |
| $R_4$ | 47 Ω | $D_2$ | Silicon Solid State Diode |
| $R_5$ | 22 Meg Ω | $D_3$ | Silicon Solid State Diode |

Modifications and variations in the device depicted and described in connection with FIGS. 1 and 2 will suggest themselves to those skilled in this art once the concept of the present invention is understood. For just one example, the circuit 20 function could be supplied by a delay relay such as a thermal type.

Accordingly, it is not intended that the scope of the present invention should be limited to the drawings or this description, these being typical and illustrative only.

As shown in FIG. 2, terminals 2 and 6 of IC 1 are connected to a conductor having effectively zero resistance. Terminal 7 is the positive power supply terminal. Terminal 4 is the negative power supply terminal. Terminals 2 and 3 are the inverting and non-inverting inputs to IC 1, respectively. Terminal 6 is the output terminal of IC 1. Amplifier IC 1 is thus a current amplifier and has a current gain at a substantially unity voltage gain. The description set forth in this paragraph is entirely conventional.

The relaxation oscillator of spark ignitor circuit 31 may be described as having a control point at either the lower or upper end of resistor $R_5$ as shown in FIG. 2.

The circuit from switch 12 in FIG. 2 is a series circuit completed through diode D4, the solenoid of pilot valve 15, pins 4 and 6, and the solenoid of main valve 21 to ground (33) and transformer secondary 41. Thus solenoids of valves 15 and 21 are connected in series, and an open in either solenoid causes both of the valves to close.

What is claimed is:

1. A gas heating system utilizing an intermittent pilot, said system comprising: a source of electrical power; a grounded pilot burner; a main burner adjacent said pilot burner to be ignited thereby; a spark ignitor having first and second input leads connected from said source; a start switch connected in series with one of said spark ignitor input leads, said second input lead being grounded, said spark ignitor having an electrode adjacent said pilot burner, and first and second output leads connected to said electrode and in a manner to permit said spark ignitor to establish a spark between said electrode over said pilot burner; a pilot solenoid valve actuable to admit gas to said pilot burner; a main solenoid valve connected to receive gas and to pass said gas to said main burner; first means responsive to actuation of said start switch to open said pilot valve and to establish said spark; a flame rod over said pilot burner; and second means connected from said flame rod to cause said main valve to open and to cause said pilot valve to remain open when a flame is produced at said pilot burner and to allow said main valve to remain closed when no flame is so produced, said first means including timing means for closing said pilot valve should a predetermined time elapse after actuation of said start switch without pilot flame ignition, said second means including a circuit to direct the same electrical current through said pilot and main valve solenoids when a pilot flame is produced, an open in either solenoid winding causing both of said valves to close.

2. A gas heating system utilizing an intermittent pilot, said system comprising: a source of electrical power; a grounded pilot burner; a main burner adjacent said pilot burner to be ignited thereby; a spark ignitor having first and second input leads connected from said source; a start switch connected in series with one of said spark ignitor input leads, said second input lead being grounded, said spark ignitor having an electrode adjacent said pilot burner, and first and second output leads connected to said electrode and in a manner to permit said spark ignitor to establish a spark between said electrode over said pilot burner; a pilot solenoid valve actuable to admit gas to said pilot burner; a main solenoid valve connected to receive gas, and to pass said gas to said main burner; first means responsive to actuation of said start switch to open said pilot valve and to establish said spark; a flame rod over said pilot burner; and second means connected from said flame rod and responsive to ignited gas over said pilot burner to cause said main valve to open and to cause said pilot valve to remain open when a flame is produced at said pilot burner and said second means is open circuited, and to allow said main valve to remain closed when said second means is short circuited, said first means including timing means for first opening said pilot valve and later for closing said pilot valve should a predetermined time interval elapse after actuation of said start switch without pilot flame ignition, said first means opening said pilot valve during said predetermined time interval and simultaneously short circuiting said second means during said predetermined time interval but open circuiting the same thereafter.

* * * * *